US010737274B2

(12) United States Patent
Schneider

(10) Patent No.: US 10,737,274 B2
(45) Date of Patent: Aug. 11, 2020

(54) APPARATUS FOR SHREDDING VALUE DOCUMENTS

(71) Applicant: GIESECKE & DEVRIENT GMBH, Munich (DE)

(72) Inventor: Stefan Schneider, Kirchheim (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 278 days.

(21) Appl. No.: 15/527,444

(22) PCT Filed: Nov. 16, 2015

(86) PCT No.: PCT/EP2015/002289
§ 371 (c)(1),
(2) Date: May 17, 2017

(87) PCT Pub. No.: WO2016/078756
PCT Pub. Date: May 26, 2016

(65) Prior Publication Data

US 2017/0341081 A1 Nov. 30, 2017

(30) Foreign Application Priority Data

Nov. 17, 2014 (DE) ..... 10 2014 016 920

(51) Int. Cl.
*B02C 18/00* (2006.01)
*B02C 18/06* (2006.01)
*B02C 18/22* (2006.01)

(52) U.S. Cl.
CPC ..... *B02C 18/0007* (2013.01); *B02C 18/06* (2013.01); *B02C 18/2283* (2013.01); *B02C 2018/0069* (2013.01)

(58) Field of Classification Search
CPC . B02C 18/0007; B02C 18/2283; B02C 18/06; B02C 2018/0069
(Continued)

(56) References Cited

U.S. PATENT DOCUMENTS 2,364,533 A * 12/1944 Jackson ..... A22C 9/008 452/142
3,286,574 A 11/1966 Durand
(Continued)

FOREIGN PATENT DOCUMENTS

DE 244761 C 3/1912
DE 3311331 A1 10/1984
(Continued)

OTHER PUBLICATIONS

German Search Report for corresponding German Application No. 102014016920.0, dated Aug. 7, 2015.
(Continued)

*Primary Examiner* — Faye Francis
(74) *Attorney, Agent, or Firm* — Workman Nydegger

(57) ABSTRACT

A shredding apparatus for value documents, includes two mutually counter-rotatable roller-shaped cutting devices which are disposed opposite each other with reference to a transport path of the value documents to be shredded, in order to cut up the value documents transported along the transport path with the aid of the cutting edges into a multiplicity of value document shreds. A stripper is allocated to each of the cutting devices, which stripper has several stripper elements arranged parallel to each other, which stripper elements engage between the cutting edges of the respective cutting device in order to remove the value document shreds from the cutting edges. The shape of the stripper elements is chosen such that the stripper elements on the front side of the respective cutting device, the front
(Continued)

side facing the transport path of the value documents, engage between the cutting edges of the respective cutting device.

16 Claims, 3 Drawing Sheets

(58) Field of Classification Search
USPC ..... 241/236
See application file for complete search history.

(56) References Cited

U.S. PATENT DOCUMENTS 3,931,935 A * 1/1976 Holman ..... B02C 17/002 241/24.1
4,545,537 A * 10/1985 Kimura ..... B02C 18/0007 241/236
4,562,971 A 1/1986 Schwelling
4,607,800 A * 8/1986 Barclay ..... B02C 18/0084 241/159
4,702,422 A * 10/1987 Chambers, Sr. .... B02C 18/0092 241/236
4,889,291 A * 12/1989 Goldhammer ..... B02C 18/0007 241/167
5,285,707 A * 2/1994 Lodovico ..... B26D 3/005 83/114
5,342,236 A * 8/1994 Repisky ..... B26D 1/24 452/142
5,400,978 A * 3/1995 Strohmeyer ..... B02C 18/0007 241/166
5,415,355 A 5/1995 Gollwitzer
5,562,255 A * 10/1996 Witko ..... B02C 18/142 241/158
5,921,482 A * 7/1999 Chou ..... B02C 18/0007 241/167
5,954,280 A * 9/1999 Kroger ..... B02C 18/0007 241/166
6,241,170 B1 * 6/2001 St. Clair ..... B02C 18/0007 241/166
6,966,513 B2 * 11/2005 Chang ..... B02C 18/0007 241/101.01
7,377,201 B2 * 5/2008 Chen ..... B26D 7/06 241/224
8,128,013 B2 * 3/2012 Bartelt ..... B02C 18/142 241/236
8,157,014 B2 * 4/2012 Hariharan ..... E21B 21/066 166/357
8,177,153 B2 * 5/2012 Leitch ..... B02C 18/00 241/236
8,882,011 B2 * 11/2014 Romanovich ..... B02C 18/0007 241/100
9,610,585 B2 * 4/2017 Zhou ..... B02C 18/0007
9,815,065 B2 * 11/2017 Boehlefeld ..... B02C 18/142
9,867,380 B2 * 1/2018 Yoshida ..... A21C 11/24
10,130,952 B2 * 11/2018 Sabol ..... B02C 18/142
2003/0089806 A1 5/2003 Galanty
2004/0104289 A1 * 6/2004 Schwelling ..... B02C 18/0007 241/236
2005/0242221 A1 * 11/2005 Rota ..... B02C 18/142 241/236
2014/0332613 A1 * 11/2014 Zhou ..... B02C 18/0007 241/166
2015/0328642 A1 * 11/2015 Shegerian ..... B02C 18/16 241/30

FOREIGN PATENT DOCUMENTS

DE 8908903 U1 10/1989
EP 0565112 A2 10/1993
GB 629181 A 9/1949
GB 2198681 A 6/1988
WO 2004014559 A1 2/2004

OTHER PUBLICATIONS

International Search Report for corresponding International PCT Application No. PCT/EP2015/002289, dated Feb. 24, 2016.

* cited by examiner

APPARATUS FOR SHREDDING VALUE DOCUMENTS

BACKGROUND

The invention relates to an apparatus for shredding value documents, such as banknotes, checks, tickets, vouchers etc.

Value documents that are no longer fit for circulation are known to be sorted out and destroyed. For example, used banknotes accepted e.g. from commercial banks, security transport companies, etc. are checked by means of banknote processing machines and sorted according to their fitness for circulation. Banknotes that have become so strongly soiled or damaged that they should not be brought back into circulation are destroyed, for example shredded. Also during the quality inspection of new banknotes immediately after their manufacture are faulty banknotes sorted out and shredded.

The shredding of the banknotes is known from EP 0565112 B1, for example. Known shredding apparatus have two rotatably supported cutting devices which rotate in opposite directions and engage each other with their cutting edges. The banknotes to be shredded are drawn in individually consecutively between the two cutting devices and thereby cut into narrow shreds by the cutting edges, said shreds being torn off longitudinally. These shreds are removed from the cutting edges by means of a stripper and drop down or are sucked off.

SUMMARY

A disadvantage of such shredders is that the cut-up banknote shreds remain hanging between the cutting edges of the cutting apparatus and are not removed completely by the stripper. The banknote shreds also interlock in addition. Some banknote shreds remain partially hanging between the cutting edges despite the stripper. Value document shreds that are drawn through between the cutting device and the stripper can interfere with the cutting process of the next value document and jam the cutting device. In addition, frequently so-called shredder beards are formed, which consist of many interlocked banknote shreds that are deposited at the end of the cutting devices. These shredder beards mainly occur when polymer banknotes are shredded. The shredder beards and/or the banknote shreds hanging between the cutting edges need to be regularly removed manually.

It is therefore an object of the invention to specify a shredding apparatus for value documents which requires fewer manual interventions.

The shredding apparatus according to the invention is configured for shredding value documents and has at least two mutually counter-rotatable, roller-shaped cutting devices which are disposed mutually opposite with reference to a transport path of the value documents to be shredded. The value documents to be shredded are transported individually, consecutively along their transport path, into between the two cutting devices in order for them to be shredded. On their surface, the two cutting devices each have a multiplicity of cutting edges which mutually engage with each other at the mutually facing front sides of the two cutting devices, in order to cut up the value documents transported along the transport path with the aid of the cutting edges into a multiplicity of value documents shreds. The cutting device has, for example, a multiplicity of cutter disks having a circular outer contour, wherein the cutting edges of the cutting device are disposed on the outside of the cutter disks and extend along their circumference.

A stripper is allocated to each of the cutting devices, which stripper has several stripper elements arranged parallel to each other and which are arranged such that the stripper elements engage between the cutting edges of the respective cutting device to remove the value document shreds from the cutting edges, in particular value document shreds located between the cutting edges. The shape of the stripper elements is chosen such that the stripper elements engage between the cutting edges of the respective cutting device on the front side of the respective cutting device, said front side facing the transport path of the value documents, however in particular do not engage between the cutting edges of the respective cutting device on the back side of the respective cutting device, said back side facing away from the transport path of the value documents. Thus it is achieved that—viewed in the direction of rotation—sufficient space is created downstream of the stripper for unstripped value document shreds which are drawn through between the stripper and the cutting device.

Within the framework of this application that side of the respective roller-shaped cutting device is referred to as the front side which faces the transport path of the value documents. Correspondingly, the back side of the roller-shaped cutting device is that side of the roller-shaped cutting device which faces away from the transport path of the value documents. The lower side of the cutting device is that side of the cutting device on which the value document shreds exit from the cutting device. The stripper surrounds the respective cutting device preferably only on the front side and lower side of the cutting device, but not on the back side of the cutting device. The lowermost angular position of the respective cutting device is that azimuthal angular position of the cutting device (i.e. with reference to the rotational axis of the cutting device), which, viewed along the direction of rotation of the cutting device, is located at 90° to the line connecting the axes of the two cutting devices (thus the center of the lower side of the cutting device).

The stripper elements are stationary, i.e. they are not moved relative to the cutting device. The stripper elements are not mounted on the axle of the cutting device, but in a receiving means present outside the cutting device. In comparison to previously known strippers which are held on the axle of the cutting device, mounting in a receiving means that is present outside the cutting device is advantageous, since the shredding apparatus can thereby be disassembled more easily into its component parts of the stripper and the cutting device, for example to remove stuck value document shreds.

The stripper elements protrude from the outside into between the cutting edges of the respective cutting device. Considering the (circular) outer contour of the roller-shaped cutting device, the stripper elements overlap with the outer contour in a (circular-arc) portion which extends over an azimuthal angle portion of the cutting device. The value documents shreds reach the overlapping angle portion in which the stripper elements overlap with the outer contour of the respective cutting device only after the cutting. The shape of the stripper elements is chosen such that the overlapping angle portion in which the stripper elements and the outer contour of the cutting device overlap extends over at most 50°, preferably at most 40°, particularly preferably at most 25°. The arc length of the overlap region along the outer contour of the cutting device preferably amounts to at most 40 mm, particularly preferably at most 20 mm. By the overlapping angle portion being so short it is achieved that as few value document shreds as possible remain hanging in the interspace between the stripper elements and the cutting device. The azimuthal position of the overlapping angle portion (azimuthal, i.e. with reference to the rotational axis of the cutting device) in which the stripper elements overlap with the outer contour of the respective cutting device is located—viewed along the direction of rotation of the cutting device—in an angle range between 20° and 100°, in particular between 20° and 80°, to the line connecting the two roller-shaped cutting devices.

At the lowermost angular position of the cutting means the radial distance of the stripper elements from the surface of the cutting device (radial with reference to the center of the roller-shaped cutting device) is at least 5 mm in particular, preferably at least 10 mm. It is thus achieved that there is a free space at the lower side of the respective cutting device, between the cutting device and the stripper, said free space being able to accommodate unstripped value document shreds that were drawn through between the stripper and the cutting device. These value document shreds can be transported away from the free space downwardly, in particular sucked off.

The shape of the stripper elements is preferably chosen such that the spacing of the stripper elements from the surface of the cutting device increases continuously along the direction of rotation of the cutting device, starting from the overlapping angle portion. Since the space available for unstripped value document shreds becomes larger continuously downstream of the stripper, a jamming of the value document shreds is prevented, thus facilitating the transporting away/sucking off of the unstripped value document shreds. For example, the stripper elements have substantially the shape of two angle legs enclosing an internal angle amounting to between 110° and 160°.

Two mutually adjacent stripper elements of the cutting device are separated from each other in each case by a spacer element which lies flatly against the two adjacent stripper elements and fills the interspace between the two stripper elements (at least where it is located). The spacer elements are arranged outside the respective cutting device. For example, the side of the spacer elements facing the respective cutting device extends parallel to the outer contour of the cutting device. The spacer elements, on their side facing the respective cutting device, are spaced apart from the surface of said cutting device by a distance that is as small as possible. Preferably, the radial spacing of the stripper elements from the outside contour of the respective cutting device is at most 1 mm. It is prevented by this small spacing that value document shreds are drawn through between the stripper and the cutting device.

The shape and mount of the stripper elements is formed such that a free space is present on the back side of the respective cutting device in the radial direction of the roller-shaped cutting device. The free space is preferably located in the lower portion of the back side of the respective cutting device. The free space is located, for example, in an (azimuthal) angle range between 90° and 180° to the connecting line of the two roller-shaped cutting devices. It can also extend over the angle range to less than 90° and/or up to over 180°, however. Starting from the surface of the cutting device, the free space extends in the radial direction preferably over a depth of at least 3 cm. The azimuthal angle range of the cutting device in which the free space extends in the radial direction over a depth of at least 3 cm amounts to at least 30°. The free space preferably extends continuously over an azimuthal angle range of the cutting device of at least 30°, over a depth of at least 3 cm.

The invention also relates to an apparatus for processing value documents having such a shredding apparatus and a transport device for transporting the value documents and for feeding the value documents to the shredding apparatus. The transport device can be formed by one or several pairs of transport rollers and/or transport belts. Further, the apparatus can comprise a suction device (suction pump, for example), which is connected to the output side of the shredding apparatus in order to suck the value document shreds from the shredding apparatus.

BRIEF DESCRIPTION OF THE DRAWINGS

Further advantages of the present invention will become apparent from the following description of the exemplary embodiments. There are shown.

DETAILED DESCRIPTION OF VARIOUS EMBODIMENTS

Figure 1A:
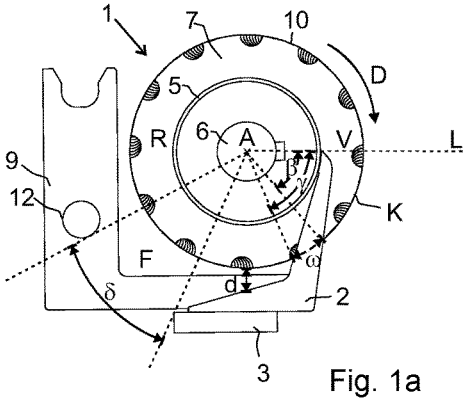
FIG. 1 *a-e* a first exemplary embodiment of the shredding apparatus (FIG. 1*e*) and components thereof (FIG. 1*a-d*), FIG. 2 a 3D view of the shredding apparatus of FIG. 1*e* from below, FIG. 3*a-b* a second exemplary embodiment of the shredding apparatus.

In FIG. 1*a*, a first exemplary embodiment is shown of a roller-shaped cutting device 1 having a multiplicity of cutter disks 7 which are separated from each other by spacer disks 5. The cutter disks 7 have several notches along their circumference between which the cutting edges 10 of the respective cutter disk are located. The cutter disks 7 and the spacer disks 5 are arranged on an axle body 6, through the center of which there extends the rotational axis A of the cutting device 1. The thickness of the cutter disks 7 is slightly smaller than that of the spacer disks 5, so that the cutter disks 17 of the second cutting device (see FIG. 1*e*) do not touch the cutter disks 7 of the first cutting device in mesh. The cutter disks 7 and the spacer disks 5 are connected firmly to one another in the axial direction and are supported rotatably about the axle body 6.

Figure 1B:
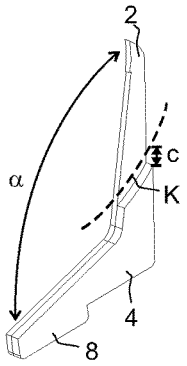

The stripper has a multiplicity of stripper elements 2, each of which engage a gap between two cutter disks 7 and extend as closely as possible to the spacer disks 5, however without touching them. To ensure a fixed distance between the stripper elements 2, these are separated from each other by spacer elements 4, see FIG. 1*b*. The stripper elements 2 are configured angularly, wherein the two angle legs in this example enclose an internal angle $\alpha$ of about 120°. The spacer elements 4 of the stripper on their side facing the transport path T of the value documents have a radial distance c of no more than 1 mm from the outer contour K of the cutting device 1.

The stripper elements 2 and their spacer elements 4 are mounted in a receiving means 3 present outside the cutting device. Said receiving means 3 can be constituted by an adhesive-filled tub in which the stripper elements 2 and the spacer elements 4, in particular their base 8, are fixed with adhesive, for example with epoxy resin. In the adhesive of the adhesive-filled tub 3 also two frame elements 9 are fixed which serve for holding the stripper.

The stripper is so positioned and the thickness of the spacer elements 4 of the stripper is chosen correspondingly, such that the stripper elements 2 protrude between the cutter disks 7 of the cutting device 1. In order for the stripper elements 2 not to rub against the cutter disks 7 between which they protrude, the thickness of the stripper elements 2 is slightly smaller than that of the spacer disks 5 of the cutting device 1. The stripper elements 2 remove value document shreds adhering to the cutting device 1 to prevent that said value document shreds are drawn through between the cutting device 1 and the stripper elements 2.

The stripper elements 2 overlap with the outer contour K of the cutting device 1—viewed along the direction of rotation D of the cutting device 1—at an angle portion ω located in an angle range between 20° and 80° to the connecting line L of the two roller-shaped cutting devices. The overlapping angle portion co starts in this example at β=50° and ends at γ=68° and extends over approximately 18°.

Figure 1C:
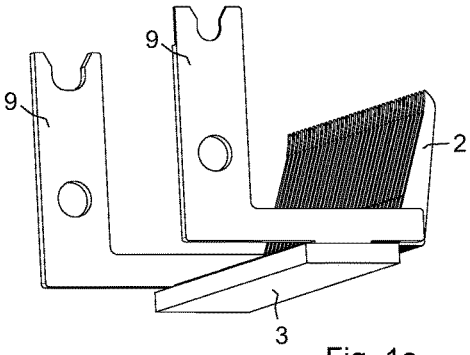
Figure 1D:
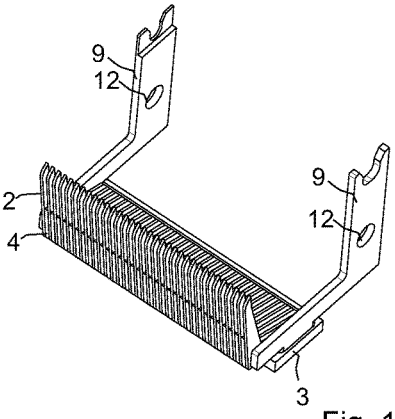

FIGS. 1*c* and 1*d* show three-dimensional views of the stripper and its holder 3. It can be seen here that between the two frame parts 9 there is a free space F that is disposed in the lower region of the back side R (facing away from the transport path T) of the cutting device 1 of FIG. 1*a*. The free space F extends from the surface of the cutting device 1 in radial direction (in FIG. 1*a* to the lower left). The free space F extends between the stripper holder 3 and the mounting pin 8 which is inserted through the receiving hole 12 of the frame part 9, see FIG. 2. Relative to the connecting line L that connects the center points of the two roller-shaped cutting devices 1 and 1' of FIG. 1*e*, the free space F in this example extends from the azimuthal angle of 115° to 153° clockwise. The free space F in this example thus extends over an azimuthal angle range 6 of 38°.

Figure 1E:
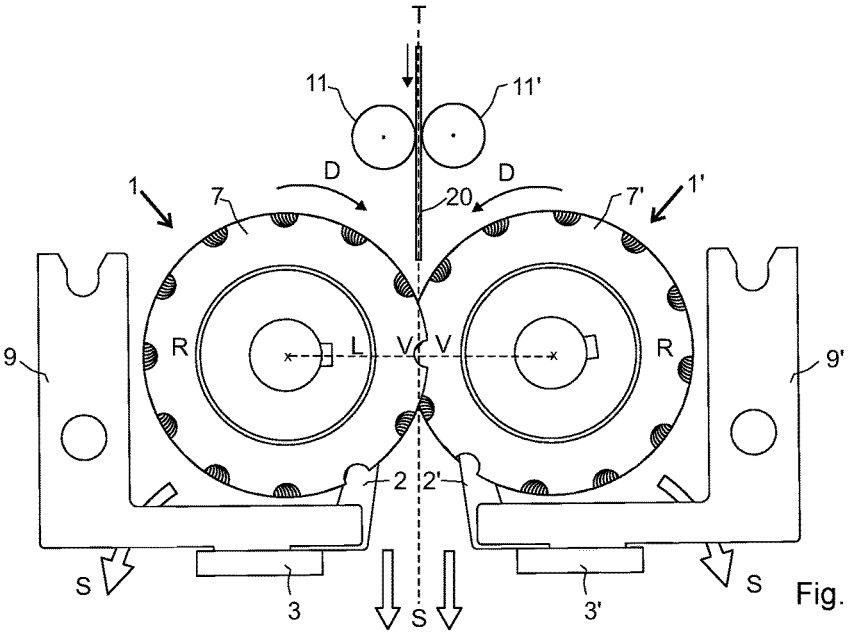

In FIG. 1*e* a shredding apparatus is shown that has two mutually counter-rotatable roller-shaped cutting devices 1, 1' (rotational direction D or D'). With the aid of a transport roller pair 11, 11' the value documents are fed along the transport path to the shredding apparatus and shredded by the same.

The cutting devices 1, 1' are configured to be axially symmetrical to each other and arranged so that their cutting edges 10 engage each other at the front sides V of the two cutting devices facing each other, see FIG. 1*a*. By the cutting edges 10 of the two cutting devices value documents 20 fed to the shredding apparatus along the transport path T are cut into a multiplicity of value document shreds. The value document shreds are sucked down. The air flow is not only effected along the two central arrows S in the extension of the transport path 20, but also from the left cutting device 1 to the lower left and/or from the right cutting device 1' to the lower right. Since there exists the free space F between the frames 9, 9', value document shreds drawn through and entering said free space can be sucked down.

Figure 2:
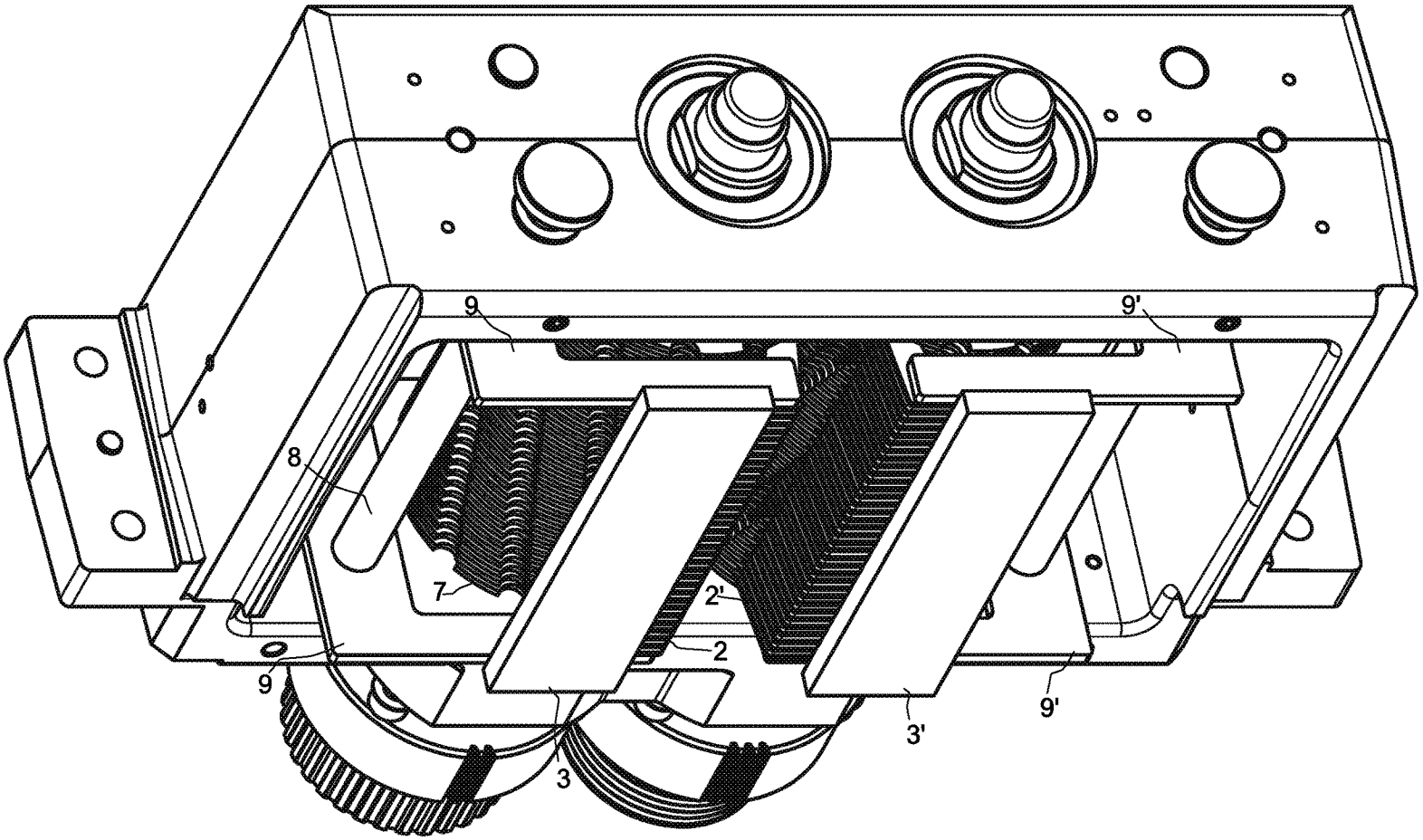

FIG. 2 shows a 3D view of the shredding apparatus from below, i.e. viewed from the output side, at which the value document shreds are transported out of the shredding apparatus.

Figure 3A:
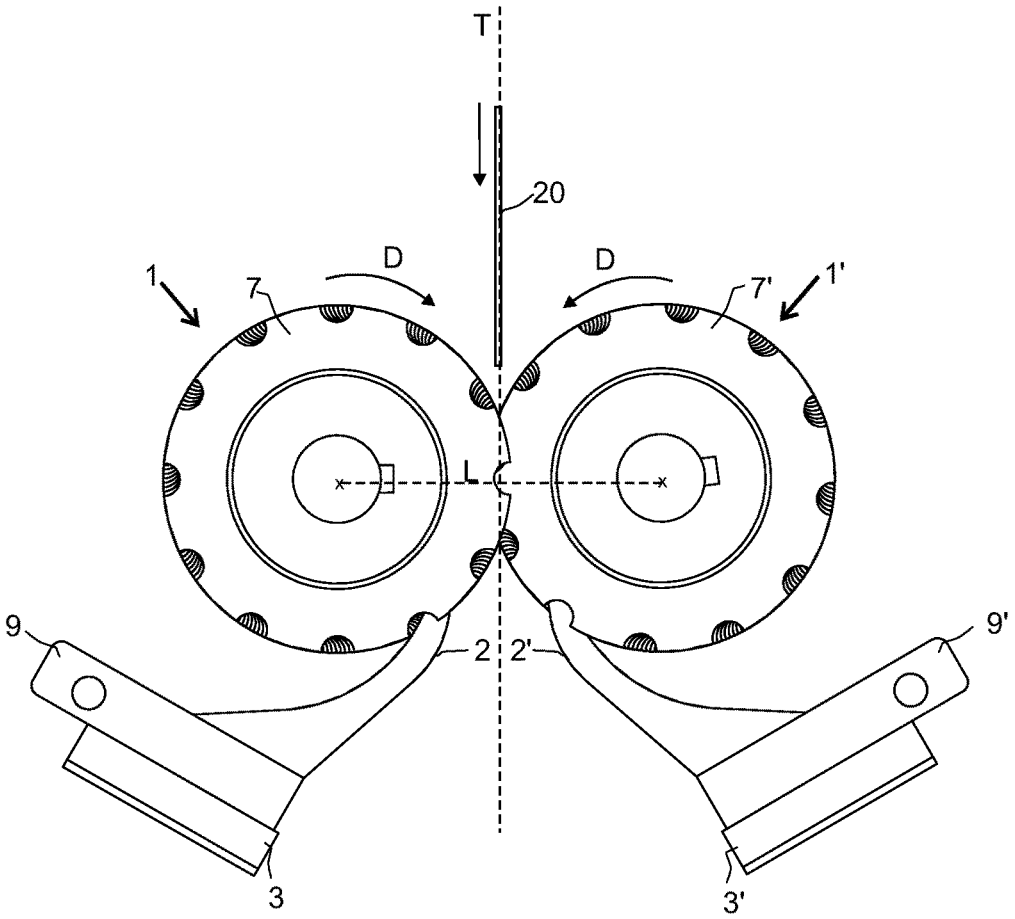
Figure 3B:
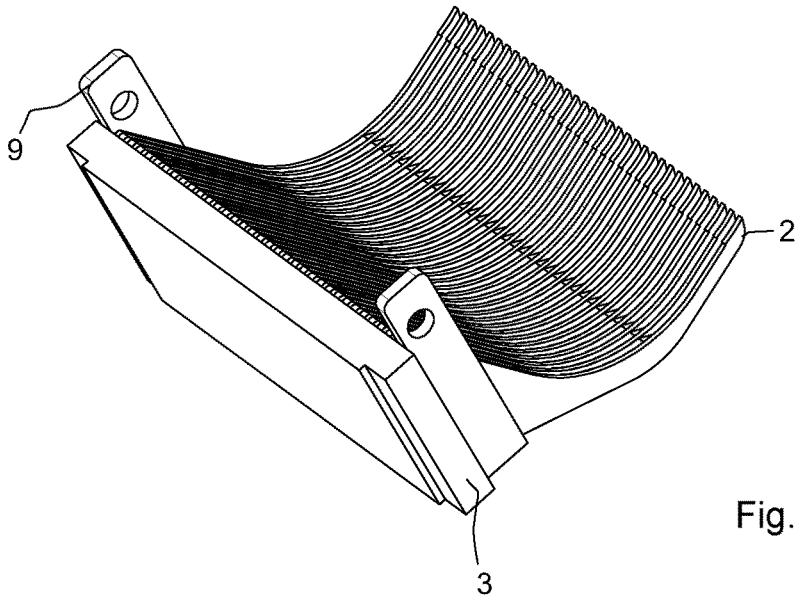

In FIGS. 3*a* and 3*b* a further embodiment of the shredding apparatus is shown, in which a different shape of the stripper elements 2 has been chosen. The angle of the apex of the two angle legs of the stripper elements 2 is located substantially farther away from the surface of the cutting device than in the stripper elements 2 of FIG. 1*a-e*. For this reason, the spacing of the stripper elements at the lowest angular position of the cutting device is substantially larger and the holder 3 of the stripper elements 2 can be placed further away from the roller-shaped cutting device 1. This results in an even bigger free space in the lower region of the back side R of the cutting device, in which drawn-through value document shreds can be accommodated and fall down or can be sucked off.

The invention claimed is:

1. An apparatus for shredding value documents, comprising:

at least two mutually counter-rotatable roller-shaped cutting devices which are disposed opposite each other with reference to a transport path for the value documents and each of which have on their surface a multiplicity of cutting edges, wherein the cutting edges of the at least two cutting devices mutually engage with each other on mutually facing front sides of the at least two cutting devices in order to cut the value documents fed along the transport path with the aid of the cutting edges into a multiplicity of value document shreds, wherein to each of the at least two cutting devices, a stripper is allocated which has several stripper elements which are arranged to be mutually parallel and so arranged that the stripper elements engage between the cutting edges of a respective cutting device in order to remove the value document shreds from the cutting edges of the respective cutting device, wherein a shape of the stripper elements is chosen such that the stripper elements engage between the cutting edges of the respective cutting device at the front side of the respective cutting device, said front side facing the transport path of the value documents, wherein the shape of the stripper elements is chosen such that a distance monotonically increases along a direction of rotation of the cutting device starting from an overlapping angle portion in which the stripper elements and an outer contour of the respective cutting device overlap and said distance being between the stripper elements and the surface of the respective cutting device.

2. The apparatus according to claim 1, wherein the stripper surrounds the respective cutting device only at the front side facing the transport path and a lower side of the respective cutting device.

3. The apparatus according to claim 1, wherein the respective stripper elements overlap with an outer contour of the respective cutting device in an azimuthal angle portion of the respective cutting device along the transport path of the value documents.

4. The apparatus according to claim 3, wherein the overlapping angle portion of the respective cutting device in which the stripper elements overlap with the outer contour of the respective cutting device—viewed along the direction of rotation of the respective cutting device is—located in an azimuthal angle range of between 20° and 100° to a connecting line that connects center points of the two roller-shaped cutting devices.

5. The apparatus according to claim 3, wherein the shape of the stripper elements is chosen so that the overlapping angle portion in which the stripper elements and the outer contour of the respective cutting device overlap, extends over at most 50°.

6. The apparatus according to claim 1, wherein mutually adjacent stripper elements of the respective cutting device are separated from each other by respectively one spacer element arranged outside the respective cutting device.

7. The apparatus according to claim 6, wherein a side of the spacer elements facing the respective cutting device has a radial spacing of at most 1 mm from the outer contour of the respective cutting device.

8. The apparatus according to claim 1, wherein the stripper elements have a form of two angle legs which enclose an inner angle amounting to between 110° and 160°.

9. The apparatus according to claim 1, wherein, at a lowest angular position of the respective cutting device on a lower side of the respective cutting device, the stripper elements have a radial spacing of at least 5 mm from the surface of the respective cutting device.

10. The apparatus according to claim 1, wherein a free space exists in radial direction at the back side of the respective cutting device, said free space extending from the surface of the respective cutting device in radial direction.

11. The apparatus according to claim 10, wherein the azimuthal angle range of the respective cutting device in which the free space extends in radial direction over a depth of at least 3 cm, is at least 30°.

12. The apparatus according to claim 10, wherein the free space is located in an azimuthal angle range between 90° and 180° to a connecting line that connects center points of the at least two roller-shaped cutting devices.

13. The apparatus according to claim 1, wherein the stripper elements and the spacer elements are mounted in a receiving means present outside the respective cutting device.

14. An apparatus for processing value documents, comprising:

a shredding apparatus for shredding value documents according to claim 1 and a transport device for transporting the value documents and for feeding the value documents to the shredding apparatus.

15. An apparatus for shredding value documents, comprising:

at least two mutually counter-rotatable roller-shaped cutting devices which are disposed opposite each other with reference to a transport path for the value documents and each of which have on their surface a multiplicity of cutting edges, wherein the cutting edges of the at least two cutting devices mutually engage with each other on the mutually facing front sides of the at least two cutting devices in order to cut the value documents fed along the transport path with the aid of the cutting edges into a multiplicity of value document shreds, wherein to each of the at least two cutting devices, a stripper is allocated which has several stripper elements which are arranged to be mutually parallel and so arranged that the stripper elements engage between the cutting edges of a respective cutting device in order to remove the value document shreds from the cutting edges of the respective cutting device, wherein a shape of the stripper elements is chosen such that the stripper elements engage between the cutting edges of the respective cutting device at the front side of the respective cutting device, said front side facing the transport path of the value documents, wherein mutually adjacent stripper elements of the respective cutting device are separated from each other by respectively one spacer element arranged outside the respective cutting device, the spacer element lying flatly against the mutually adjacent stripper elements and filling an interspace between the mutually adjacent stripper elements outside the respective cutting device.

16. The apparatus according to claim 15, wherein a surface of the spacer element facing the respective cutting device is parallel to the outer contour of the respective cutting device.

* * * * *